US008579425B2

(12) United States Patent
Hoff

(10) Patent No.: US 8,579,425 B2
(45) Date of Patent: Nov. 12, 2013

(54) SEAL AND SECONDARY FILM FOR INK TANK

(75) Inventor: Joseph W. Hoff, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 13/359,762

(22) Filed: Jan. 27, 2012

(65) Prior Publication Data

US 2013/0194356 A1 Aug. 1, 2013

(51) Int. Cl.
*B41J 2/175* (2006.01)

(52) U.S. Cl.
USPC ..... 347/86

(58) Field of Classification Search
USPC ..... 347/84, 85, 86
See application file for complete search history.

(56) References Cited

U.S. PATENT DOCUMENTS

| | | | | |
|---|---|---|---|---|
| 5,831,652 | A | 11/1998 | Hinami et al. | |
| 6,036,306 | A * | 3/2000 | Haigo | 347/86 |
| 6,270,207 | B1 * | 8/2001 | Sasaki | 347/86 |
| 6,447,109 | B1 * | 9/2002 | Williamson et al. | 347/85 |
| 6,464,339 | B1 | 10/2002 | Ardito | |
| 7,350,902 | B2 | 4/2008 | Dietl et al. | |

* cited by examiner

*Primary Examiner* — Anh T. N. Vo
(74) *Attorney, Agent, or Firm* — Peyton C. Watkins

(57) ABSTRACT

An ink tank that is mountable to a printhead, the ink tank includes a wall including an ink outlet configured to supply ink to the printhead; a first film including a sealing portion that is adhered to a sealing area surrounding the ink outlet; and a second film adhered to the first film, the second film configured to capture ink residue when the first film is removed from the sealing area.

20 Claims, 17 Drawing Sheets

SEAL AND SECONDARY FILM FOR INK TANK

Reference is made to commonly assigned, co-pending U.S. patent application Ser. No. 13/359,746, filed Jan. 27, 2012, entitled "Seal and Seal Pulling Member for Ink Tank" by Joseph Hoff, the disclosure of which is herein incorporated by reference.

FIELD OF THE INVENTION

The present invention relates generally to the field of ink tanks for inkjet printheads, and more particularly to a seal that is removed from the ink tank before the ink tank is installed on the printhead.

BACKGROUND OF THE INVENTION

An inkjet printer typically includes one or more printheads and their corresponding ink supplies. A printhead includes an array of drop ejectors, each ejector includes an ink chamber, an ejecting actuator and a nozzle through which droplets of ink are ejected. The ejecting actuator may be one of various types, including a heater that vaporizes some of the ink in the chamber in order to propel a droplet out of the nozzle, or a piezoelectric device which changes the wall geometry of the chamber in order to produce a pressure wave that ejects a droplet. The droplets are typically directed toward paper or other recording medium in order to produce an image according to image data that is converted into electronic firing pulses for the drop ejectors as the print medium is moved relative to the printhead.

Ink is provided to the printhead through an inlet port of the printhead. In some printers the corresponding ink supply can be located remotely from the printhead and connected to it, for example by tubing. Alternatively in other printers, an ink supply, also called an ink tank or ink reservoir, can be directly coupled to the printhead. For the case of ink tanks mounted on the carriage of a carriage printer, the ink tank can be permanently mounted onto the printhead, so that the printhead needs to be replaced when the ink is depleted, or the ink tank can be detachably mounted onto the printhead, so that only the ink tank itself needs to be replaced when the ink tank is depleted. Carriage mounted ink tanks typically contain only enough ink for up to about several hundred prints. This is because the total mass of the carriage needs be limited, so that accelerations of the carriage at each end of the travel do not result in large forces that can shake the printer back and forth. As a result, users of carriage printers having detachably mounted ink tanks need to replace the ink tanks periodically, depending on their printing usage, typically several times per year. An ink tank design facilitating easy and clean installation of a detachable ink tank is beneficial.

Inkjet ink includes a variety of volatile and nonvolatile components including pigments or dyes, humectants, image durability enhancers, and carriers or solvents. For proper operation of the inkjet printhead it is important that the ink transferred from the outlet port of the ink tank to the inlet port of the printhead have the appropriate balance of these ink components. Therefore, during shipping and storage of an inkjet ink tank it is common practice to provide a seal over the outlet port(s) of the ink tank in order to inhibit the evaporative loss of the volatile components of the ink. U.S. Pat. No. 6,464,339 discloses a removable seal that is adhesively attached over the outlet port of an ink tank.

A problem that can occur when removing a seal that is adhered around the outlet port is that it can be difficult for the user to remove the seal in a controllable fashion. Particularly if the seal is removed rapidly, a sticking of the seal and then sudden release as it is pulled off can cause ink on the seal to be flung off. The ink spatter can get on the user's hands or clothing.

Consequently, a need exists for an ink tank that facilitates easy and clean removal of the seal prior to installation onto the printhead.

SUMMARY OF THE INVENTION

The present invention is directed to overcoming one or more of the problems set forth above. Briefly summarized, according to one aspect of the invention, the invention resides in an ink tank that is mountable to a printhead, the ink tank comprising a wall including an ink outlet configured to supply ink to the printhead; a first film including a sealing portion that is adhered to a sealing area surrounding the ink outlet; and a second film adhered to the first film, the second film configured to capture ink residue when the first film is removed from the sealing area.

These and other objects, features, and advantages of the present invention will become apparent to those skilled in the art upon a reading of the following detailed description when taken in conjunction with the drawings wherein there is shown and described an illustrative embodiment of the invention.

DETAILED DESCRIPTION OF THE INVENTION

Figure 1:
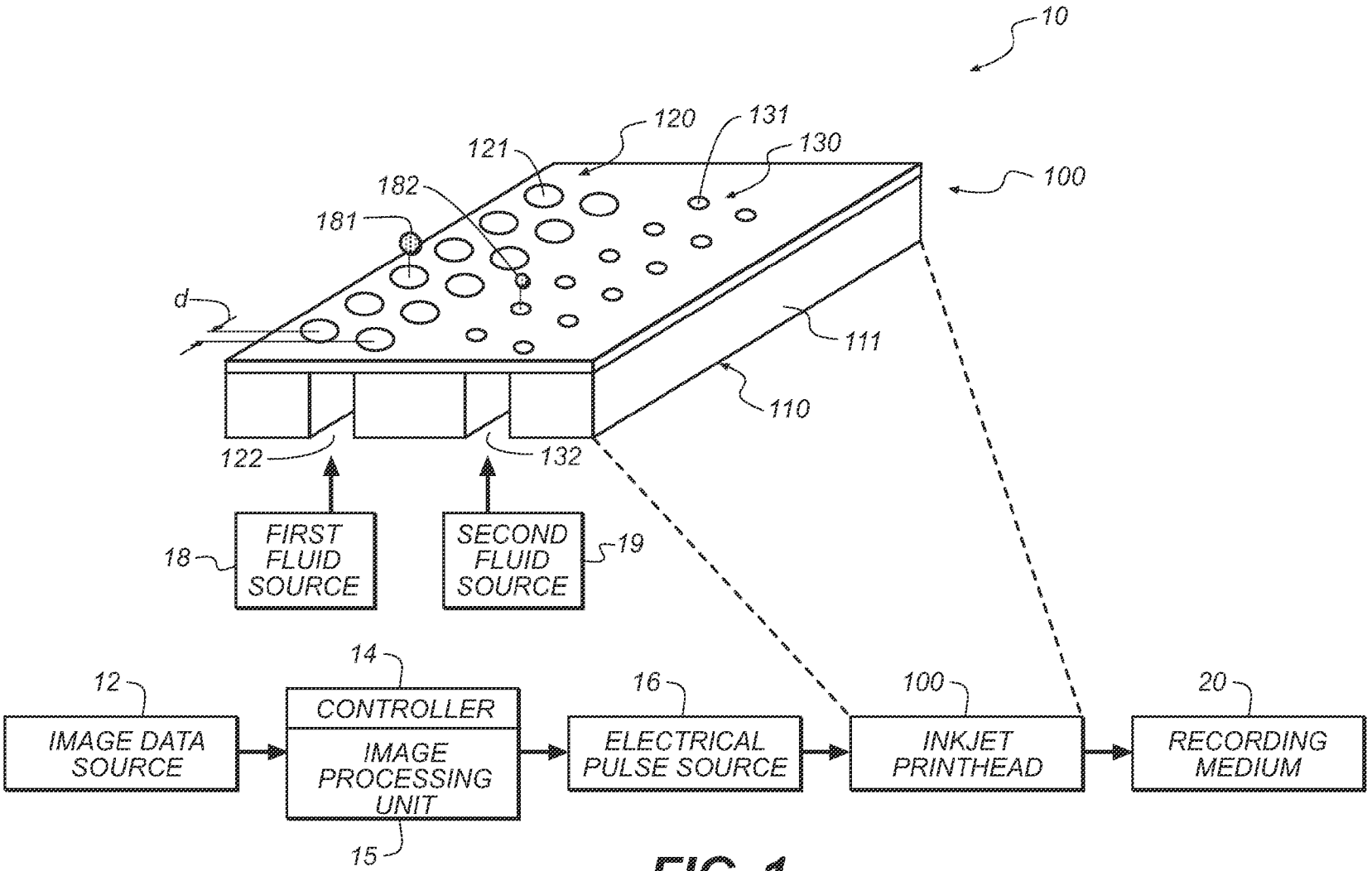
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays 120, 130 has two staggered rows of nozzles 121, 131 each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles 121, 131 from one row of an array would print the odd numbered pixels, while the nozzles 121, 131 from the other row of the nozzle array 120, 130 would print the even numbered pixels.

In fluid communication with each nozzle array 120, 130 is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to both the first nozzle array 120 and the second nozzle array 130 via ink delivery pathways 122 and 132 respectively. Also, in some embodiments, fewer than two or more than two nozzle arrays 120, 130 can be included on printhead die 110. In some embodiments, all nozzles on inkjet printhead die 110 can be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
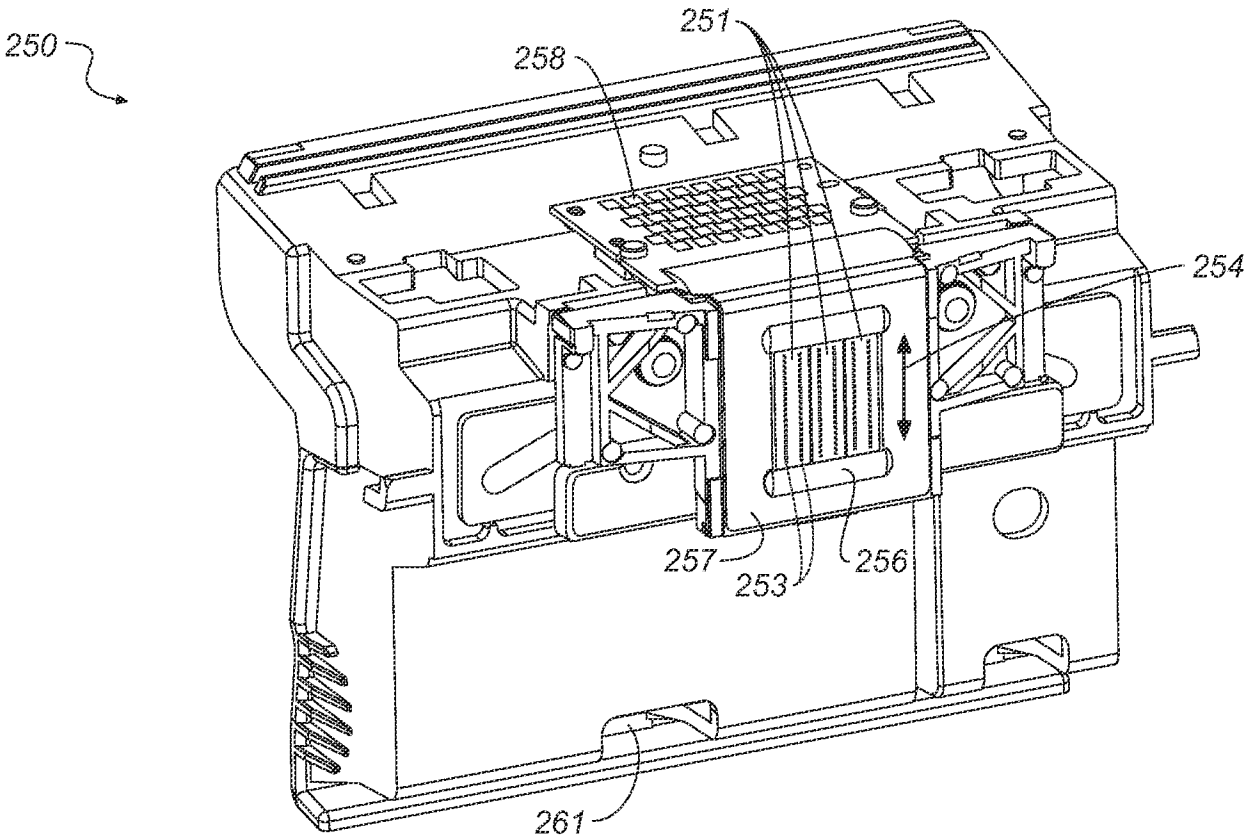
FIG. 2 is a perspective of a portion of a printhead.

FIG. 2 shows a bottom perspective of a portion of a printhead 250, which is an example of an inkjet printhead 100. Printhead 250 includes three printhead die 251 (similar to printhead die 110 in FIG. 1), each printhead die 251 containing two nozzle arrays 253, so that printhead 250 contains six nozzle arrays 253 altogether. The six nozzle arrays 253 in this example can each be connected to separate ink sources (not shown in FIG. 2); such as cyan, magenta, yellow, text black, photo black, and a colorless protective printing fluid. Each of the six nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving printhead 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead 250 and connects to connector board 258. When printhead 250 is mounted into the carriage 200 (see FIG. 3), connector board 258 is electrically connected to a connector (not shown) on the carriage 200, so that electrical signals can be transmitted to the printhead die 251.

As described below, one or more ink reservoirs (also called ink tanks herein) are detachably mountable in printhead 250. In the bottom perspective of FIG. 2, a ledge on printhead 250 is provided as a catch 261 to engage with a latch on an ink tank (not shown in FIG. 2). When catch 261 is engaged with the latch on an ink tank, the ink tank is held in its mounted position.

Figure 3:
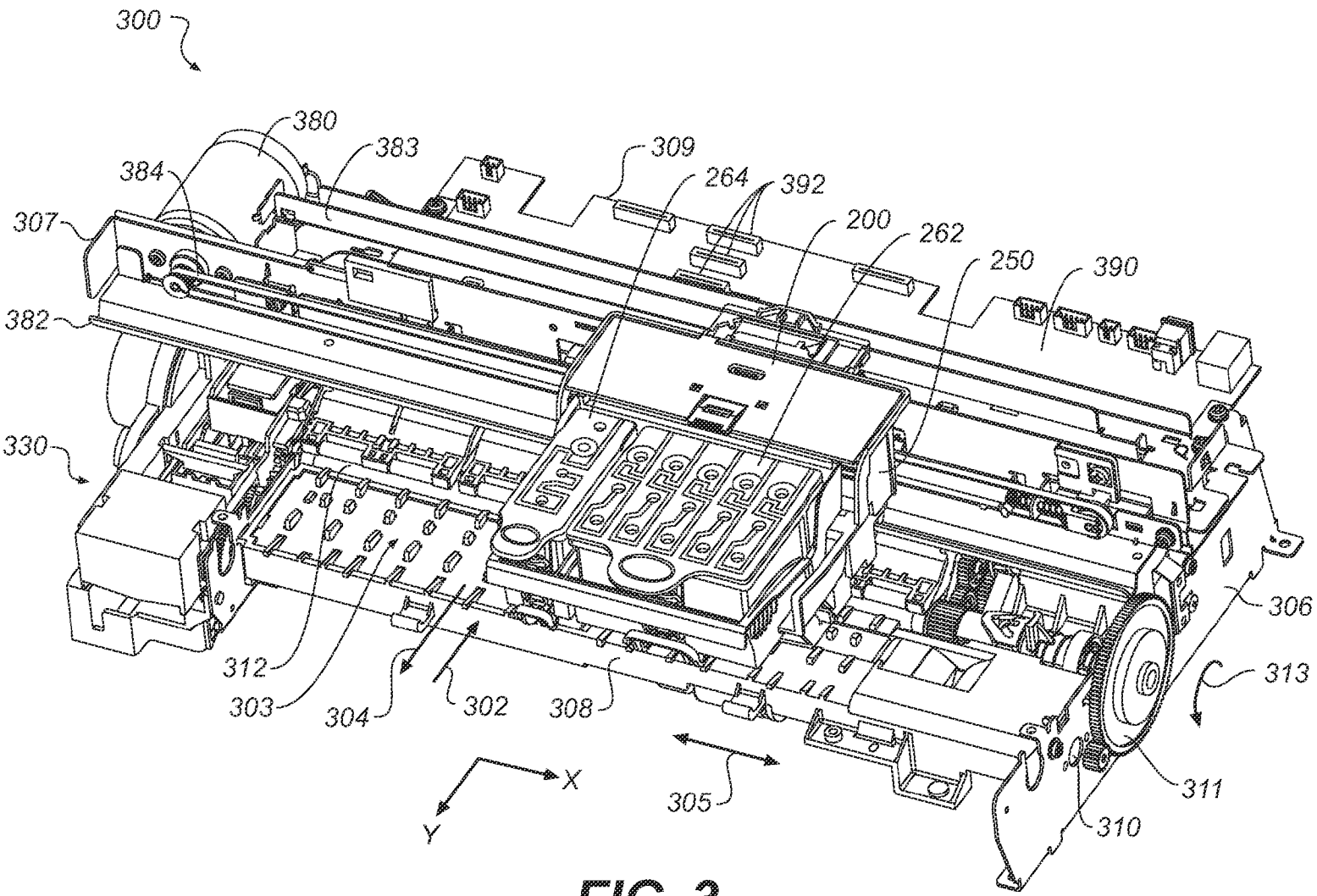
FIG. 3 is a perspective of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 (not shown in FIG. 3) on printhead 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead 250 is mounted in carriage 200, and multi-chamber ink tank 262 and single-chamber ink tank 264 are mounted in the printhead 250. When the ink tanks 262 and 264 are mounted in the printhead 250, as in FIG. 3, the combined assembly of printhead 250 and ink tanks 262 and 264 is called an inkjet printhead assembly. The mounting orientation of printhead 250 is rotated relative to the view in FIG. 2, so that the printhead die 251 are located at the bottom side of printhead 250, the droplets of ink ejected downward onto the recording medium in print region 303 in the view of FIG. 3. Multi-chamber ink tank 262, in this example, contains five ink sources: cyan, magenta, yellow, photo black, and colorless protective fluid; while single-chamber ink tank 264 contains the ink source for text black. Paper or other recording medium (sometimes generically referred to as paper or media herein) is loaded along paper load entry direction 302 toward the front of printer chassis 308.

Figure 4:
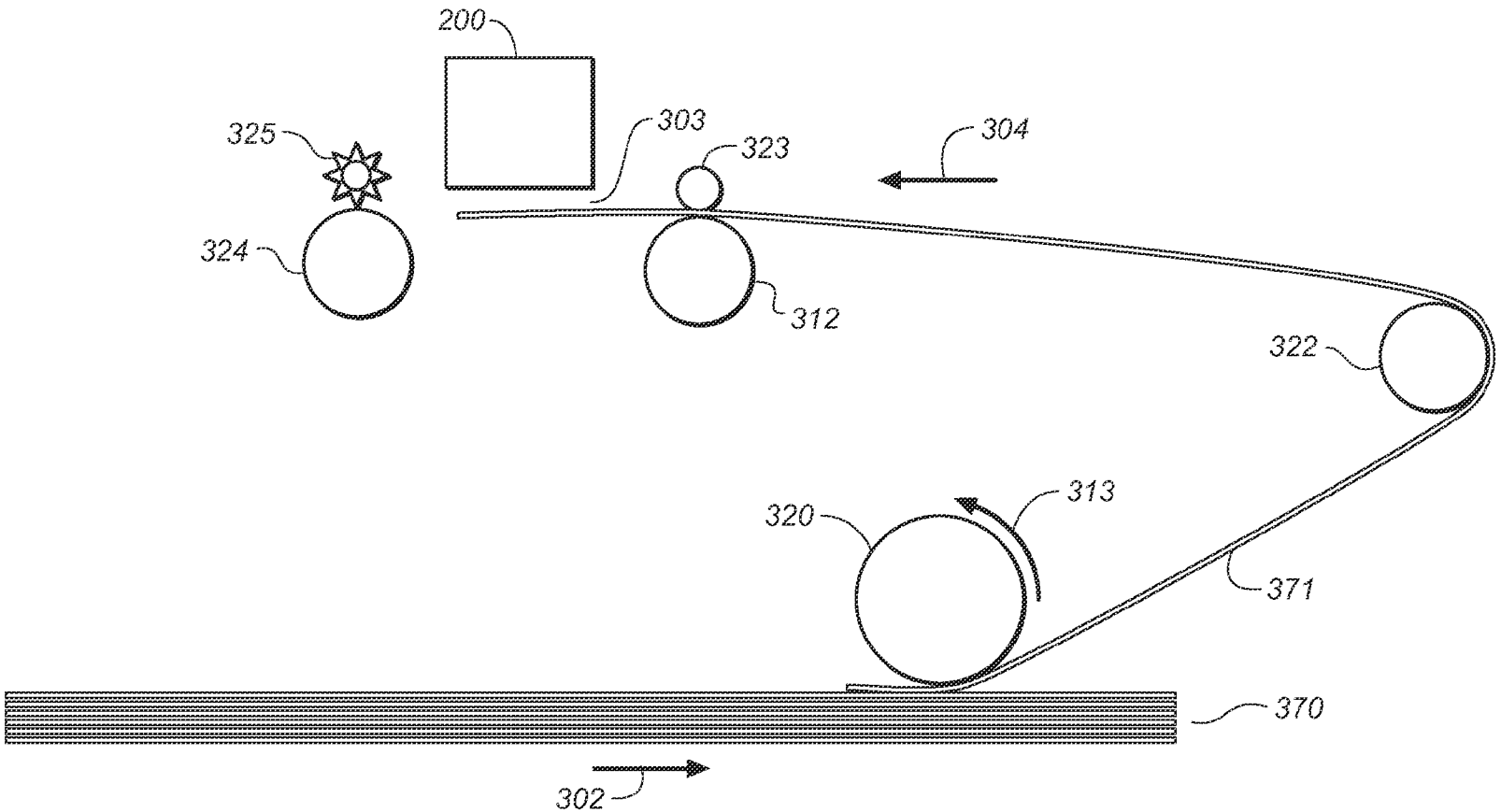
FIG. 4 is a schematic side view of an exemplary paper path in a carriage printer.

A variety of rollers are used to advance the recording medium 20 through the printer as shown schematically in the side view of FIG. 4. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller 312.

The motor that powers the paper advance rollers is not shown in FIG. 3, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330.

Toward the rear of the printer chassis 309, in this example, is located the electronics board 390, which includes cable connectors 392 for communicating via cables (not shown) to the printhead carriage 200 and from there to the printhead 250. Also on electronics board 390 are typically mounted motor controllers for the carriage motor 380 and for the paper advance motor, a processor and other control electronics (shown schematically as controller 14 and image processing unit 15 in FIG. 1) for controlling the printing process, and an optional connector for a cable to a host computer.

Figure 5:
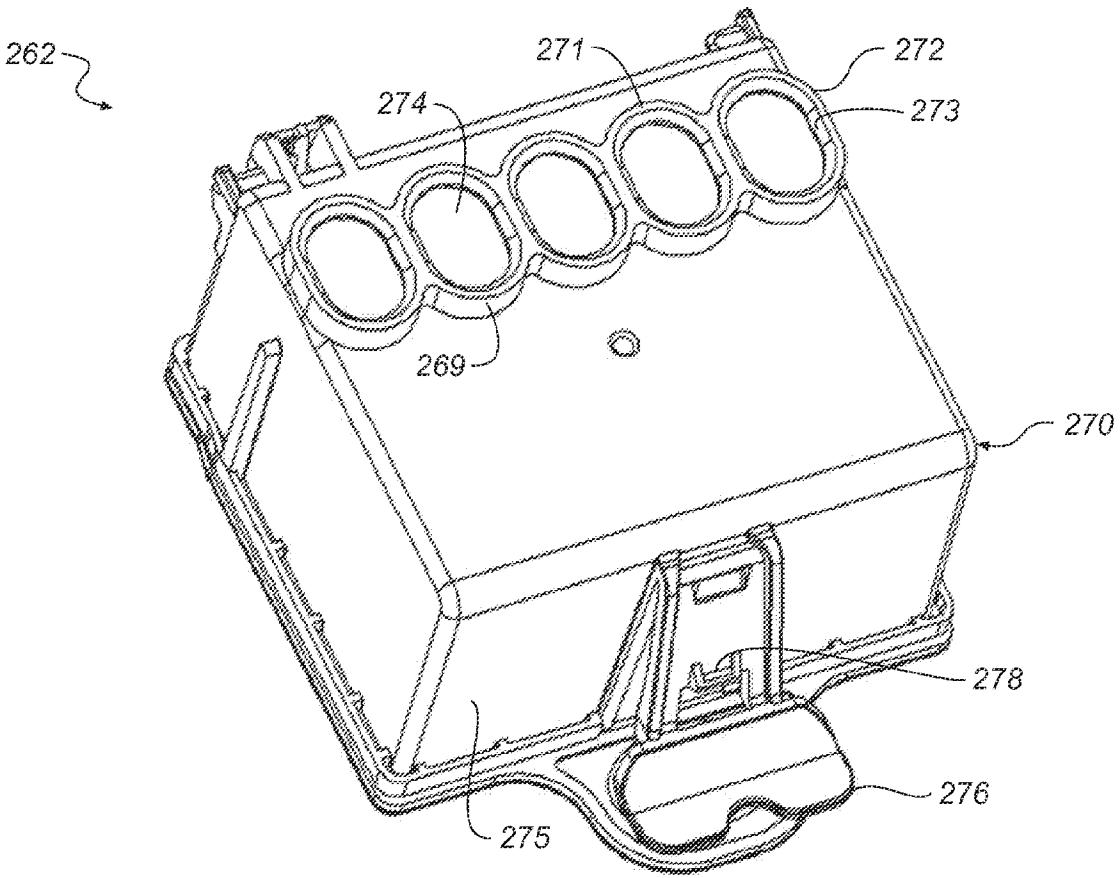
FIG. 5 is a bottom perspective of a multi-chamber ink tank.
Figure 6:
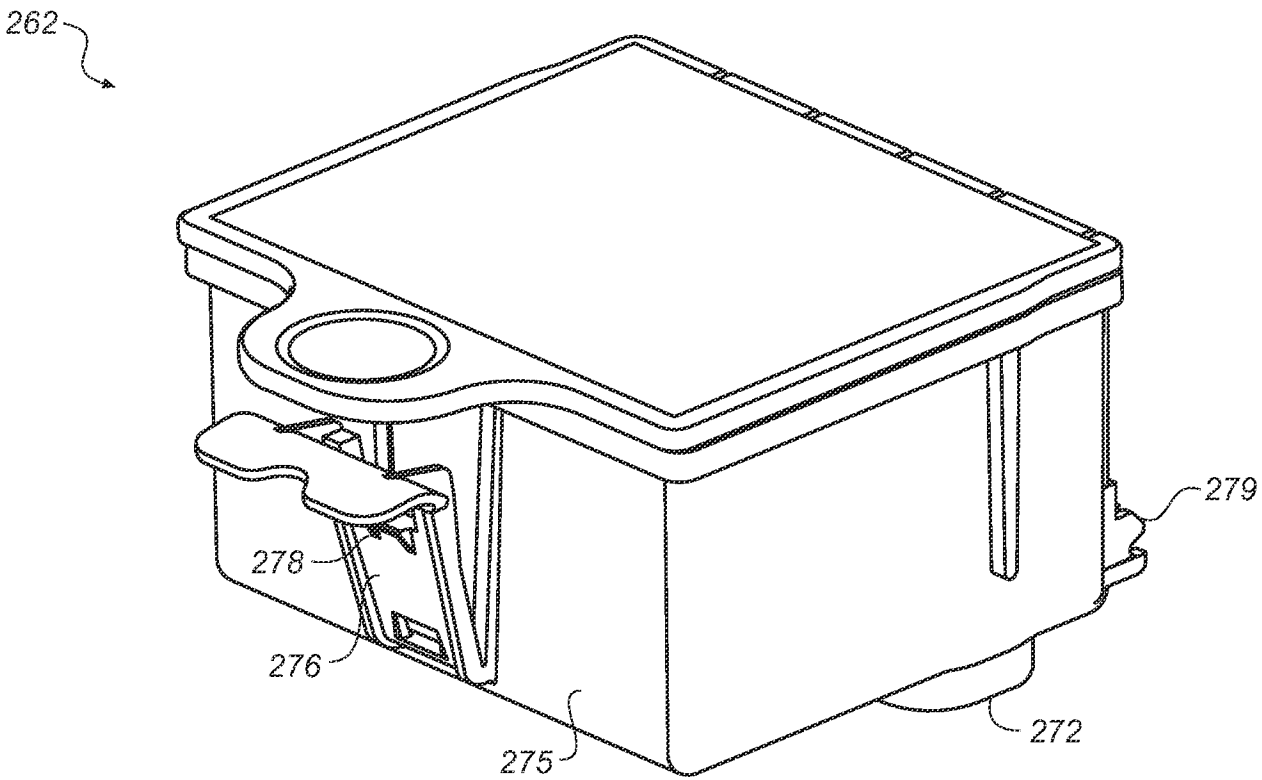
FIG. 6 is a top perspective of a multi-chamber ink tank.

FIG. 5 shows a bottom perspective and FIG. 6 shows a top perspective of multi-chamber ink tank 262. Five outlet ports 272 (each corresponding to an ink source) extend from a bottom surface of a tank body 270 of multi-chamber ink tank 262. Each outlet port 272 has an outlet opening 273, which is oval-shaped in the example of FIG. 5. A raised rim 269 surrounds each outlet opening 273 and the raised rim 269 includes a sealing face 271. A wick 274 is disposed at each outlet opening 273 for transferring of ink to the corresponding inlet port of printhead 250. Wick 274 is a porous member that can be made of a fibrous material (such as a felted material) or a sintered material (such as a sintered plastic) in various embodiments. A latching lever 276 extends outwardly from a back wall 275 of multi-chamber ink tank 262. Latching lever 276 includes a latch 278 that engages with catch 261 (see FIG. 2) on printhead 250 when multi-chamber ink tank 262 is mounted onto printhead 250. A guide feature 279 is provided on a wall opposite back wall 275 for guiding multi-chamber ink tank 262 into proper position on printhead 250.

Figure 7:
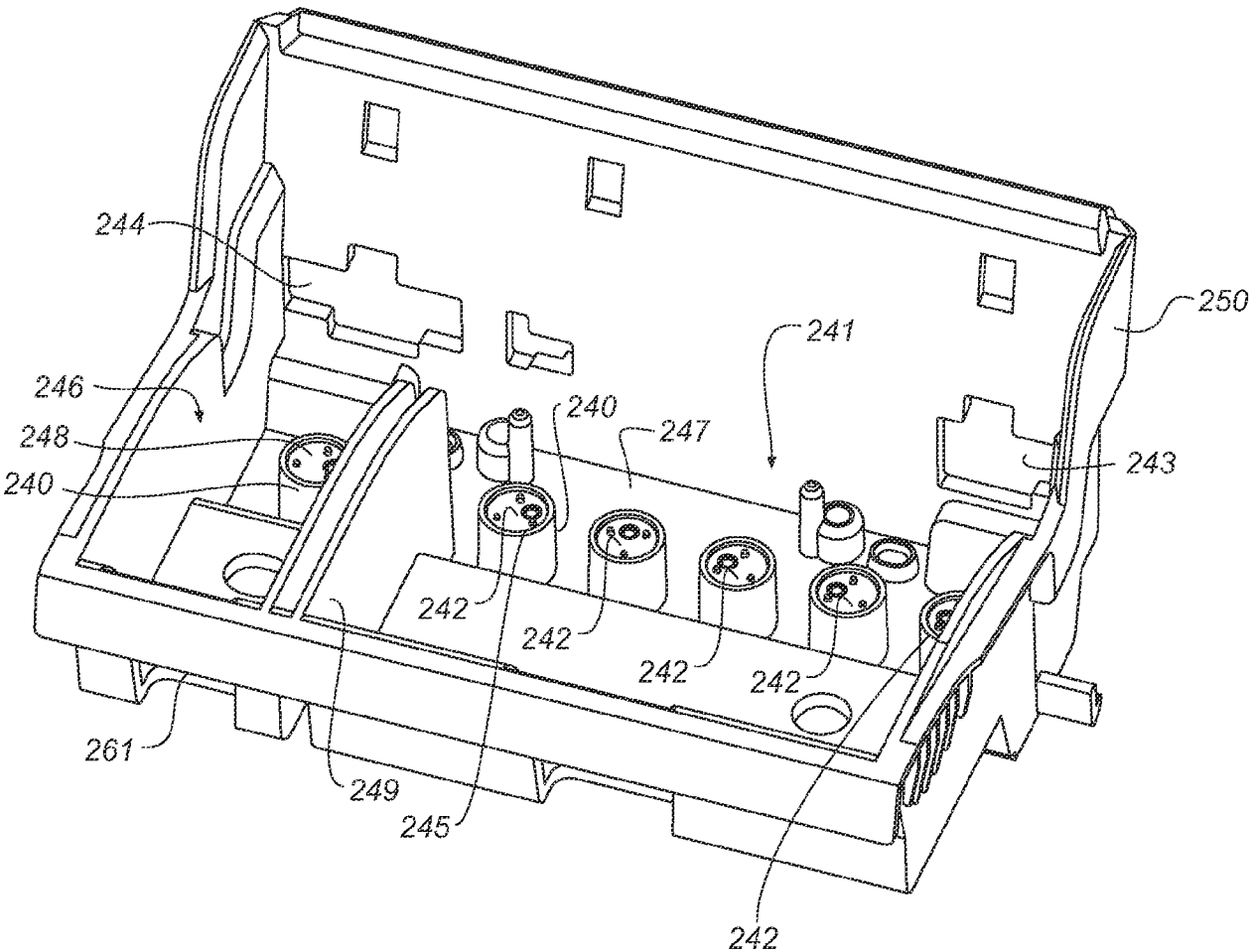
FIG. 7 is a perspective of a printhead without ink tanks mounted.

FIG. 7 shows a perspective of printhead 250 without either replaceable ink tank 262 or 264 mounted onto it. Multi-chamber ink tank 262 is mountable in a region 241 and single chamber ink tank 264 is mountable in region 246 of printhead 250. Region 241 is separated from region 246 by partitioning wall 249, which can also help guide the ink tanks during installation. Guide feature 279 of multi-chamber ink tank 262 is inserted into a hole 243 of printhead 250 during mounting of the multi-chamber ink tank 262. A similar guide feature (not shown) on single chamber ink tank 264 is inserted into hole 244 of printhead 250 during mounting of the single chamber ink tank 264. Five inlet ports 242 are shown in region 241 that connect with ink outlet ports 272 of multi-chamber ink tank 262 when it is installed onto printhead 250, and one inlet port 248 is shown in region 246 for the ink tank port on the single chamber ink tank 264. In the example of FIG. 7 each inlet port 242 or 248 has the form of a standpipe 240 that extends from the floor of printhead 250. Typically a filter (such as woven or mesh wire filter, not shown) covers the end 245 of the standpipe 240. The diameter of end 245 of standpipe 240 is smaller than that of the outlet openings 273 of ink tank 262 or 264, so that the end 245 of each standpipe 240 is pressed into contact with a corresponding wick 274. When an ink tank is installed onto the printhead 250, it is in fluid communication with the printhead 250 because of the connection of the wicks 274 at outlet ports 272 with the ends 245 of standpipes 240 of inlet ports 242 or 248. Not shown in FIG. 7 is a gasket that is located on floor 247 and surrounds each of the standpipes 240. When an ink tank is installed onto the printer chassis 300, sealing face 271 (FIG. 5) of each outlet port 272 seals against the gasket on floor 247 to inhibit ink from leaking out and air from leaking into the ink passageways.

Figure 8:
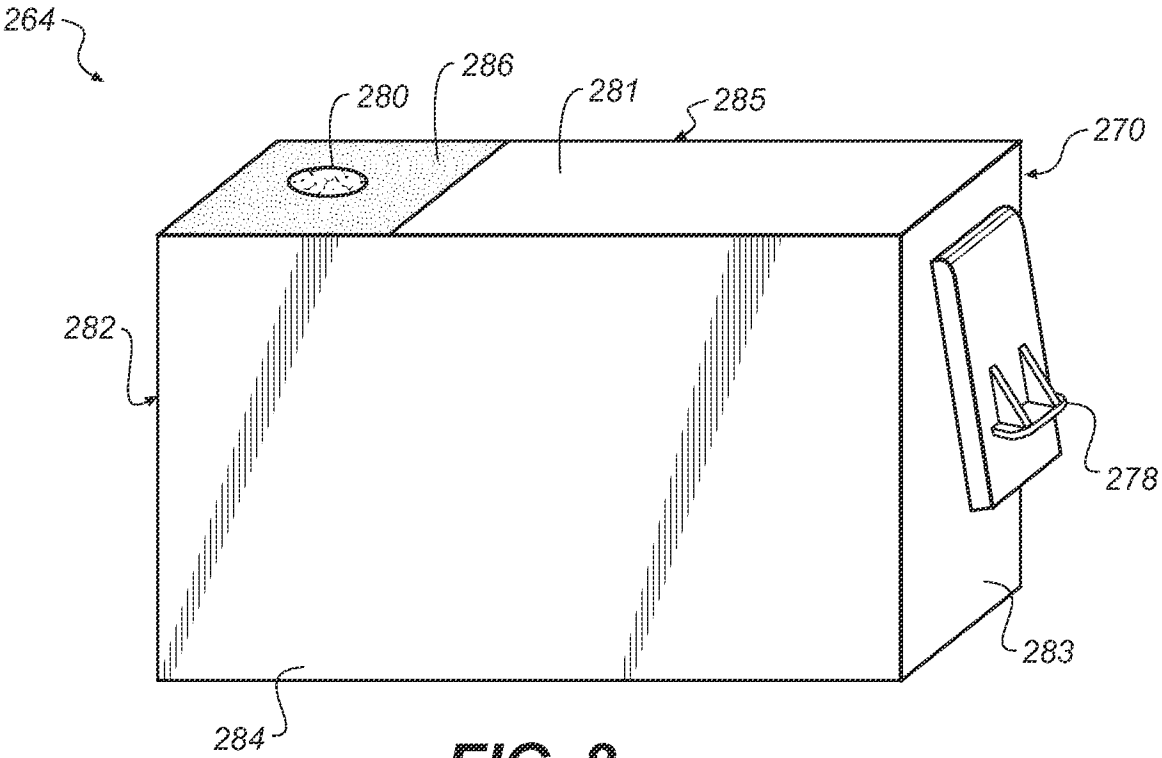
FIG. 8 is a perspective of an ink tank including an ink outlet.

FIG. 8 is a perspective of a single-chamber ink tank 264 including a tank body 270 having a first wall 281, a second wall 282 intersecting a first end of the first wall 281, a third wall 283 intersecting a second end of the first wall 281, a first side wall 284 intersecting first wall 281 and extending from second wall 282 to third wall 283, and a second side wall 284 also intersecting first wall 281 and extending from second wall 282 to third wall 283. First wall 281 includes an ink outlet 280 configured to supply ink to a printhead 250 (FIG. 2). Unlike outlet port 272 of FIG. 5, ink outlet 280 does not have a raised rim that extends outwardly from first wall 281. A sealing area 286 surrounds ink outlet 280. A latch 278 extends from third wall 283.

Figure 9:
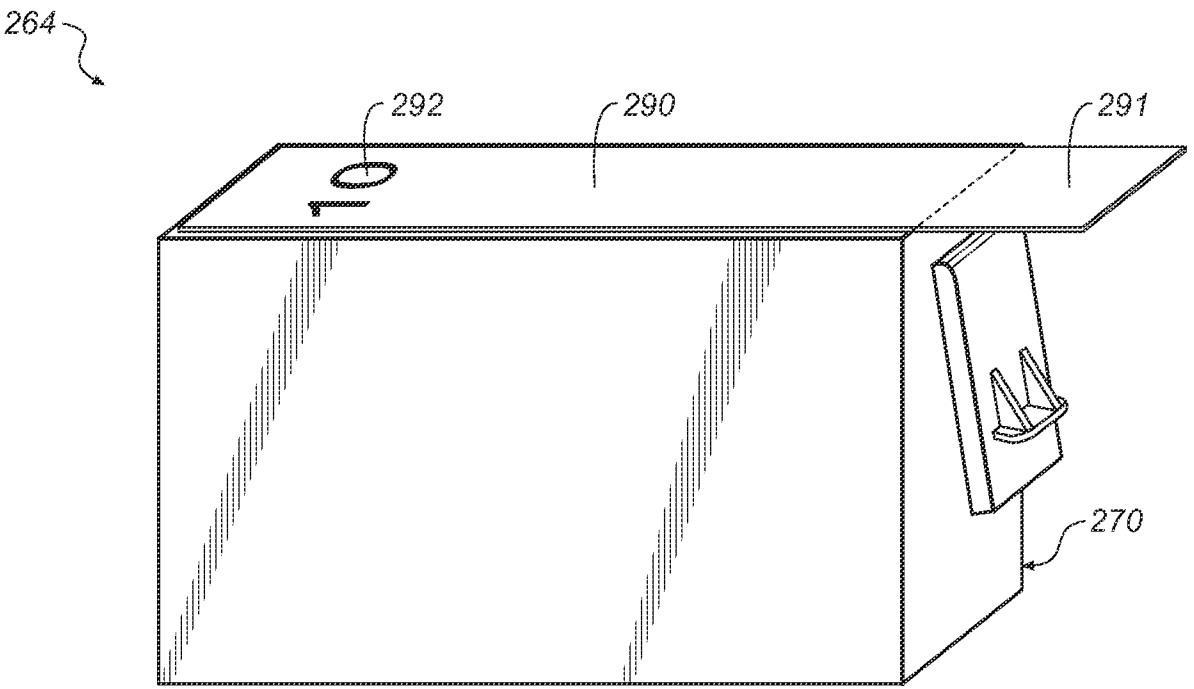
FIG. 9 is a perspective of an ink tank with a sealing film adhered to a sealing area around the ink outlet.

FIG. 9 is a perspective similar to FIG. 8, but also including a sealing film 290. An underside portion of sealing film 290 is sealed to sealing area 286 (FIG. 8). A visible side of sealing film 290 (opposite the underside) can include a label 292 indicating a type of ink tank, a manufacturer's brand, and other such information. Sealing film 290 also can include a pull tab 291 for the user to grasp when the sealing film 290 is removed before the ink tank 264 is installed into a printhead 250.

Figure 10:
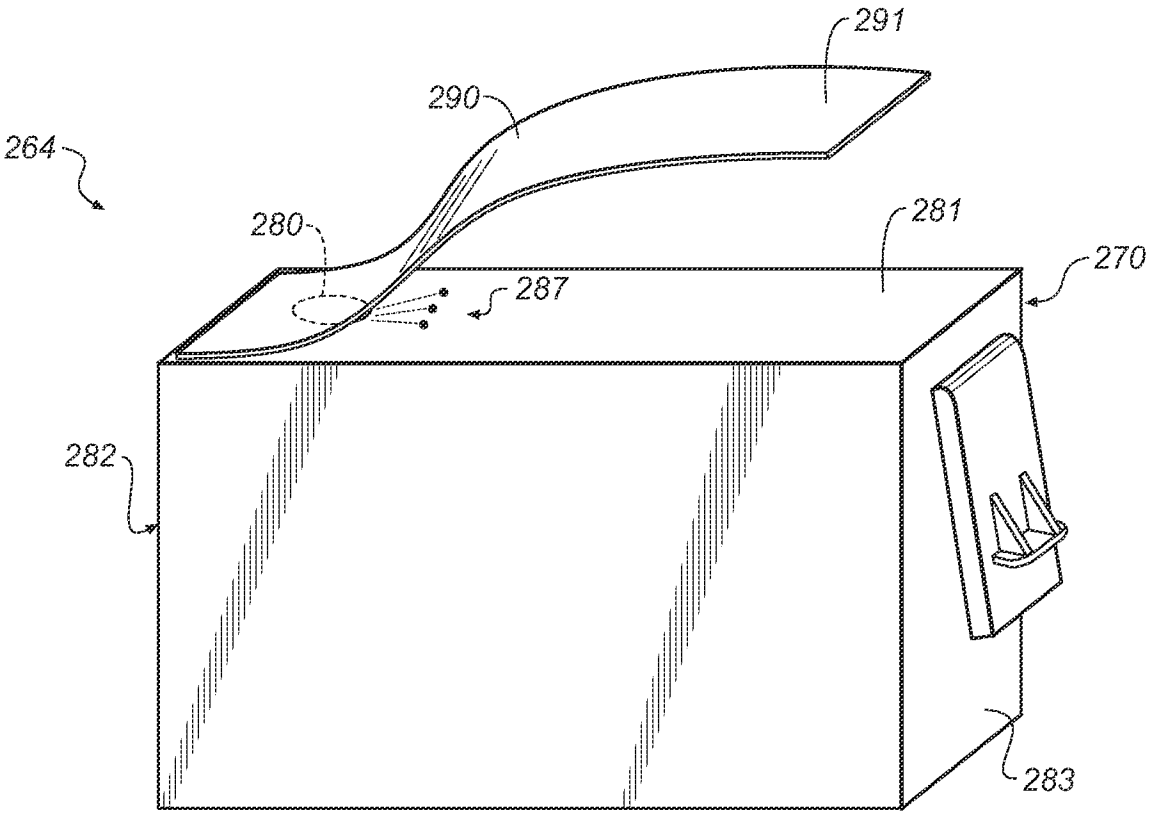
FIG. 10 (PRIOR ART)
FIG. 10 is a perspective of a prior art ink tank as the sealing film is removed.

FIG. 10 is a perspective of a prior art sealing film 290 in the process of being removed from single-chamber ink tank 264. As pull tab 291 of sealing film 290 is pulled in a direction from third wall 283 toward second wall 282, a sticking of the sealing film 290 and then sudden release as it is pulled off can cause ink on the sealing film 290 to be flung off. The ink spatter droplets 287 can land on the user's fingers, his clothing, the tank body 270, or other inconvenient locations.

Figure 11:
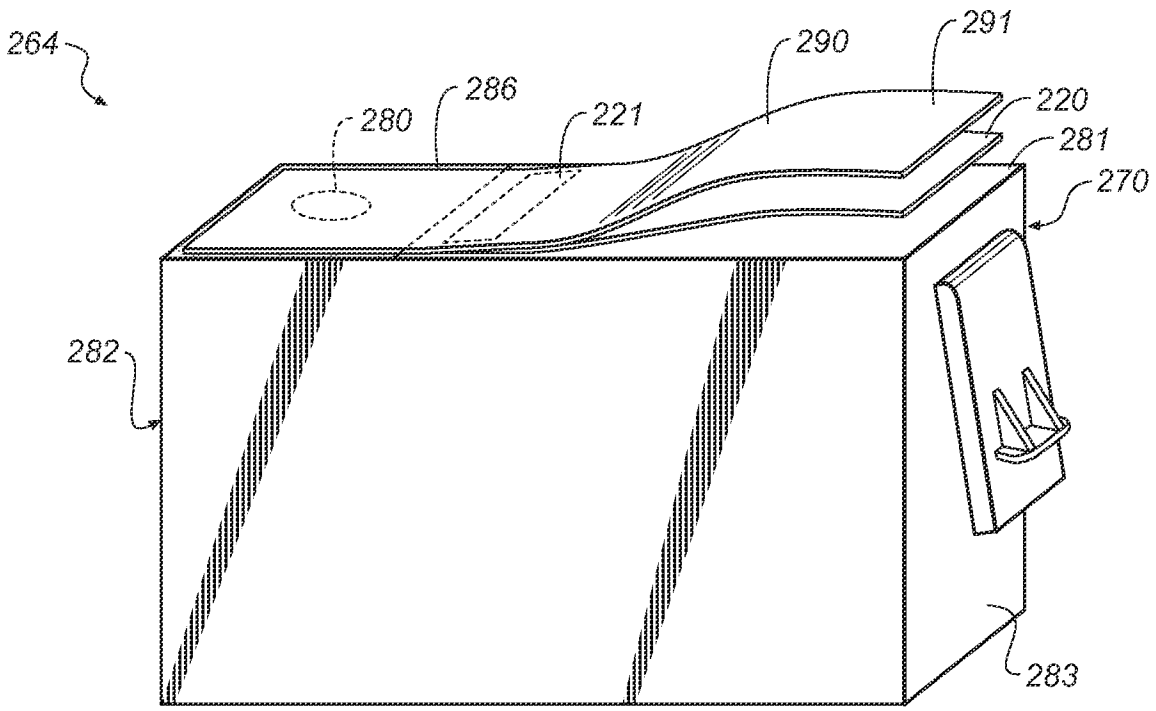
FIG. 11 is a perspective of an ink tank with a sealing film and a second film according to an embodiment of the invention.

FIG. 11 is a perspective of an embodiment of the present invention. In addition to sealing film 290 that is adhered to a sealing area 286 surrounding ink outlet 280, a second film 220 is disposed between sealing film 290 and first wall 281 in order to capture ink residue resulting from ink spatter droplets 287 (FIG. 10) when sealing film 290 is removed from sealing area 286. Second film 220 is adhered to sealing film 290 in an adhesion location 221 (bounded by the dashed lines in FIG. 11). Adhesion location 221 is typically located near sealing area 286, but not overlapping sealing area 286. In other words, the second film 220 does not interfere with the sealing of sealing film 290 to sealing area 286 surrounding the ink outlet 280.

Figure 12:
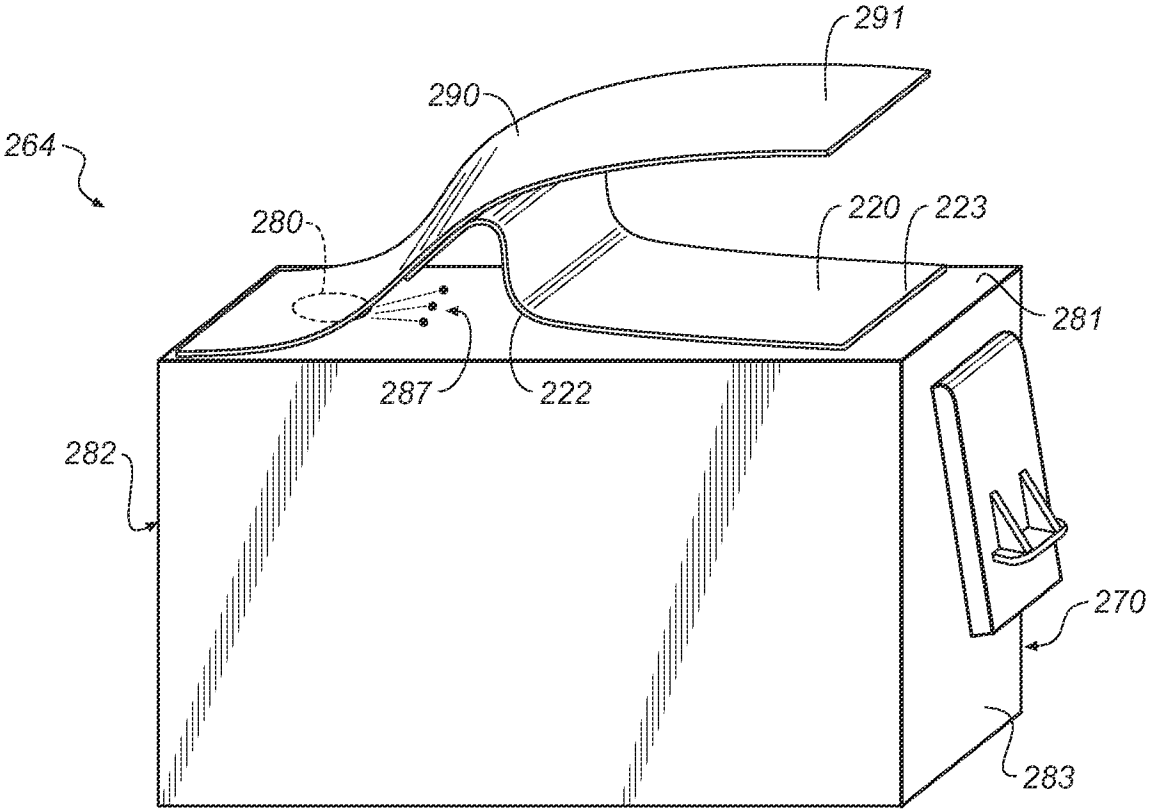
FIG. 12 is a perspective of the ink tank of FIG. 11 as the sealing film is removed.

Second film 220 is typically not adhered to first wall 281. An end 223 of second film 220 located near third wall 283 is also typically not attached to sealing film 290. As shown in FIG. 12, as sealing film 290 is pulled using pull tab 291, end 223 of second film 220 tends to droop away from sealing film 290. Ink spatter droplets 287 tend to hit an underside 222 of second film 220, so that the ink residue is captured between the underside 222 of the second film 220 and sealing film 290 as second film 220 folds toward sealing film 290.

Figure 13:
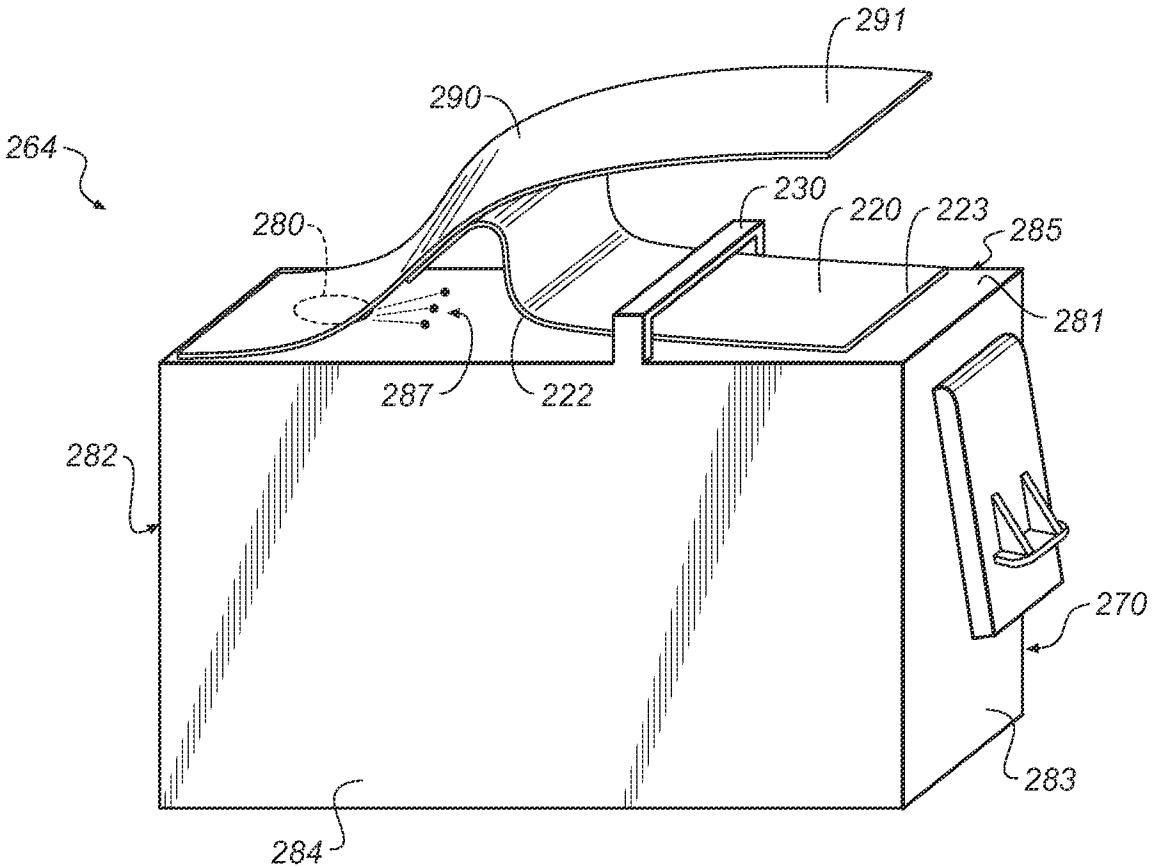
FIG. 13 is a perspective of an embodiment where a guide member projects outwardly.

In some embodiments, as shown in FIG. 13, a guide member 230 that is spaced apart from first wall 281 is provided in order to help control the motion of second film 220 so that under side 222 tends to fold toward sealing film 290 and capture the residue from ink spatter droplets 287. Guide member 230 typically extends along a direction that is perpendicular or substantially perpendicular to first side wall 284 and second side wall 285. Second film 220 is threaded between first wall 281 and guide member 230. Guide member 230 is located between first wall 281 and sealing film 290. As sealing film 290 is pulled toward ink outlet 280, the user also tends to pull sealing film 290 away from first wall 281. Guide member 230 constrains second film 220 to stay near first wall 281. This causes under side 222 of second film 220 to fold toward the sealing portion of sealing film 290 when the sealing film 290 is removed from the sealing area 286 (FIG. 11).

There are a variety of different configurations for the guide member 230. In the embodiment shown in FIG. 13, first wall 281 is defined by a plane near guide member 230, and guide member 230 projects outwardly from the plane of the first wall 281. In the embodiment shown in FIG. 14 (with the sealing film 290 and second film 220 removed for clarity), first wall 281 includes a recess 235. Guide member 230 is spaced apart from the recess 235 of first wall 281, so that the outer surface of guide member 230 is substantially flush with the plane of first wall 281. In the embodiment shown in FIG. 15, the single-chamber ink tank 264 includes a first guide tab 231 located near first side wall 284 and a second guide tab 232 located near second side wall 285. Guide tabs 231 and 232 function as a guide member. In any case, the guide member 230 is typically integrally formed together with ink tank 262 during an injection molding process, so that tank body 270 is made of a molded material and guide member 230 is made of the same molded material.

Figure 14:
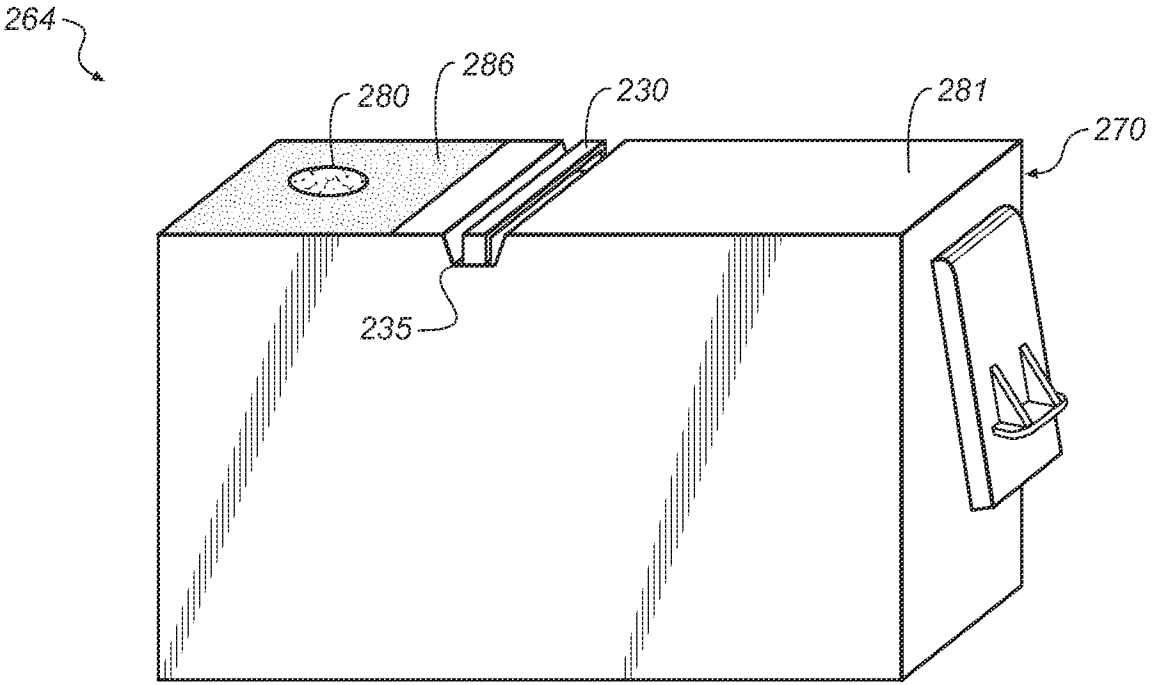
FIG. 14 is a perspective of an embodiment where a guide member is spaced apart from a recess.
Figure 15:
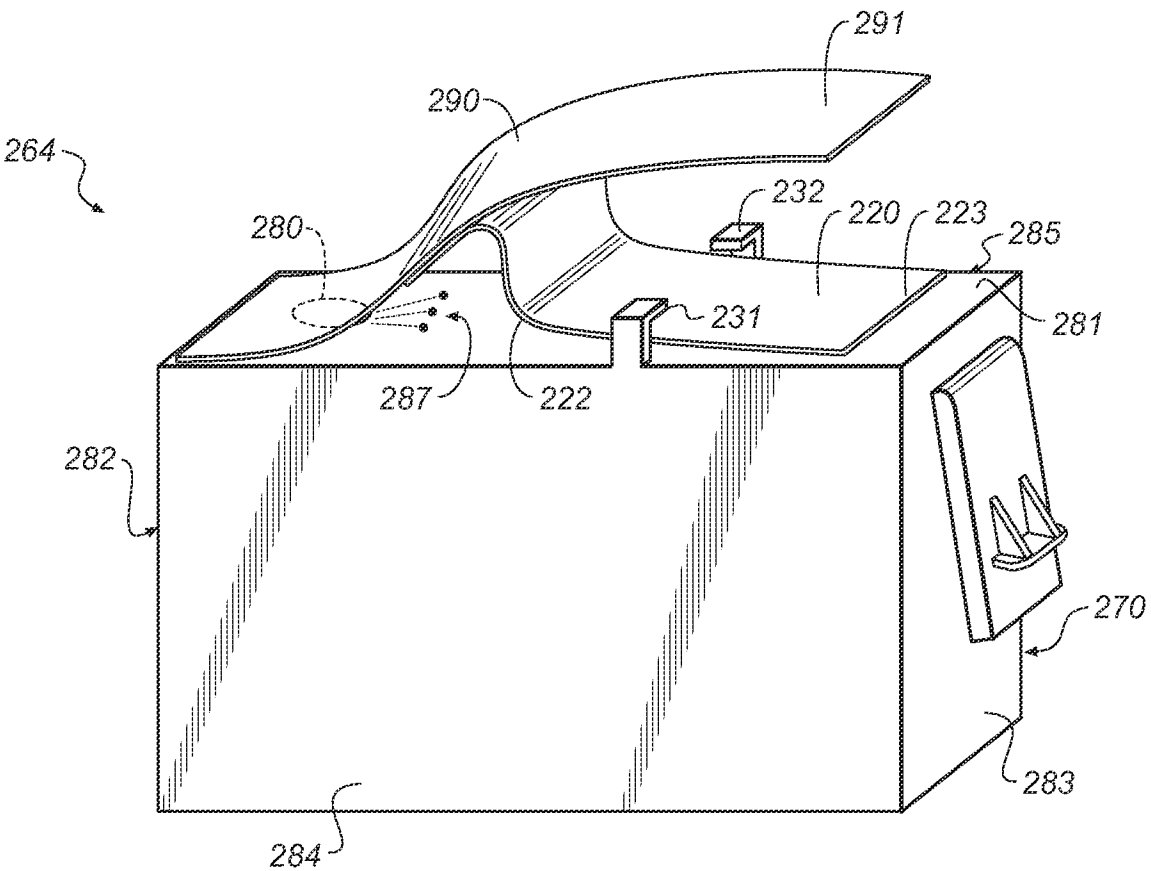
FIG. 15 is a perspective of an embodiment where the ink tank includes a pair of guide tabs.
Figure 16:
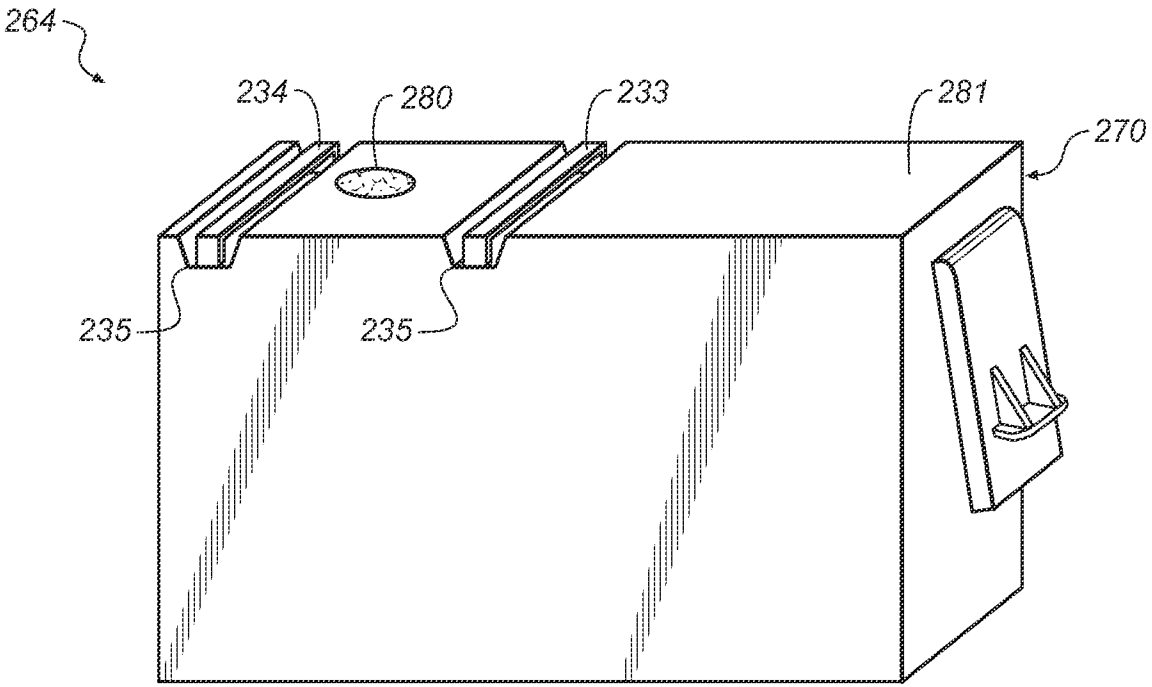
FIG. 16 is a perspective of an embodiment where the ink tank includes two guide members.
Figure 17:
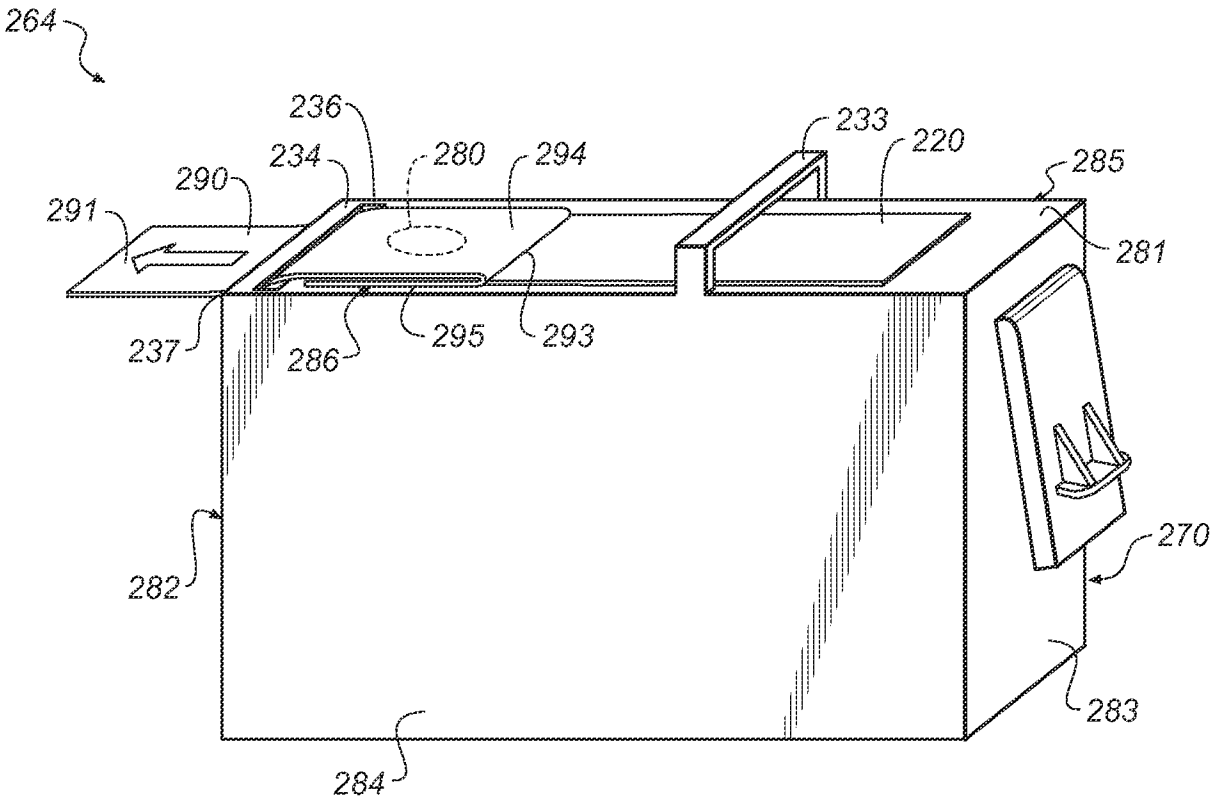
FIG. 17 is a perspective of an embodiment where the ink tank includes two guide members and the sealing film includes a fold.

FIG. 16 shows an embodiment similar to that of FIG. 14, with a first guide member 233 spaced apart from a recess 235 of first wall 281, and also including a second guide member 234 spaced apart from a second recess 235 on the opposite side of ink outlet 280. FIG. 17 shows another embodiment having two guide members 233 and 234, although in the example of FIG. 17 first guide member 233 projects outwardly from the plane of first wall 281, and second guide member 234 includes a slot 236 near a corner 237 of tank body 270. The following description of removal of the sealing film 290 in FIG. 17 is similar to that of FIG. 16 as those skilled in the art can readily discern. Pull tab 291 of sealing film 290 is threaded through slot 236. Sealing film 290 is configured to have a fold 293 between an upper portion 294 and a sealing portion 295. Sealing portion 295 is adhered to sealing area 286. Upper portion 294 is not adhered. When the user pulls pull tab 291 in the direction indicated by the arrow on pull tab 291, sealing film 290 is pulled away from sealing area 286 beginning near fold 293. Also adhered to sealing film 290 near fold 293 is second film 220. As sealing film 290 is pulled away from sealing area 286, second film 220 is pulled along with it so that any ink spatter residue is captured between sealing film 290 and second film 220.

Second film 220 can be specially designed for improved ink residue capturing capability. For example, second film 220 can include an absorbent material such as paper, fabric, or coated plastic. The under side 222 of second film 220 can be provided with an ink fixing material.

Sealing film 290 can be adhered to sealing area 286 using an adhesive. Alternatively it can be adhered to sealing area 286 by heat staking or ultrasonic welding. Although embodiments discussed relative to FIGS. 11-15 included an ink outlet 280 shown as an opening in first wall 281, the invention is also applicable to ink tanks such as that shown in FIG. 5 where outlet port 272 includes a raised rim having a sealing face 271. In such embodiments, sealing face 271 is the same as sealing area 286.

The invention has been described in detail with particular reference to certain preferred embodiments thereof, but it will be understood that variations and modifications can be effected within the spirit and scope of the invention.

PARTS LIST d density
10 Inkjet printer system
12 Image data source
14 Controller
15 Image processing unit
16 Electrical pulse source
18 First fluid source
19 Second fluid source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
220 Second film
221 Adhesion location
222 Under side
223 End
230 Guide member
231 First guide tab
232 Second guide tab
233 First guide member
234 Second guide member
235 Recess
236 Slot
237 Corner
240 Standpipe
241 Region (for mounting multi-chamber ink reservoir)
242 Inlet port
243 Hole
244 Hole
245 End
246 Region (for mounting single chamber ink reservoir)
247 Floor
248 Inlet port
249 Partitioning wall
250 Printhead
251 Printhead die
253 Nozzle array
254 Nozzle array direction
256 Encapsulant
257 Flex circuit

258 Connector board
261 Catch for ink tank latching mechanism
262 Multi-chamber ink tank
264 Single-chamber ink tank
269 Rim
270 Tank body
271 Sealing face
272 Outlet port
273 Outlet opening
274 Wick
275 Back wall
276 Latching lever
278 Latch
279 Guide feature
280 Ink outlet
281 First wall
282 Second wall
283 Third wall
284 First side wall
285 Second side wall
286 Sealing area
287 Ink spatter droplets
290 Sealing film
291 Pull tab
292 Label
293 Fold
294 Upper portion
295 Sealing portion
300 Printer chassis
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
370 Stack of media
371 Top piece of medium
380 Carriage motor
382 Carriage guide rail
383 Encoder fence
384 Belt
390 Printer electronics board
392 Cable connectors

The invention claimed is:

1. An ink tank that is mountable to a printhead, the ink tank comprising:

a tank body including:

a first wall including an ink outlet configured to supply ink to the printhead;

a second wall intersecting the first end of the first wall;

a first film including a sealing portion that is adhered to a sealing area surrounding the ink outlet; and a second film adhered to the first film, the second film configured to capture ink residue when the first film is removed from the sealing area;

a third wall intersecting second end of the first wall, wherein the sealing area is proximate the second wall and wherein the second film is detached from the first film in a region proximate the third wall;

a first side wall and a second side wall intersecting the first wall and extending from the second wall to the third wall; and a guide member spaced apart from the first wall, wherein the guide member extends along a direction that is substantially perpendicular to the first side wall and the second side wall.

2. The ink tank of claim 1, wherein the second film is adhered to the first film in a location proximate but not overlapping the sealing area.

3. The ink tank of claim 1, wherein the second film is not adhered to the first wall.

4. The ink tank of claim 1, wherein the guide member is a first guide member, the ink tank further comprising a second guide member.

5. The ink tank of claim 1, the first wall including a recess, wherein the guide member is spaced apart from the recess of the first wall.

6. The ink tank of claim 1, wherein the first wall is defined by a plane proximate the guide member, wherein the guide member projects outwardly from the plane of the first wall.

7. The ink tank of claim 1, the tank body comprising a molded material, wherein the guide member includes the same molded material as the tank body.

8. The ink tank of claim 1, wherein the second film is disposed between the first wall and the guide member.

9. The ink tank of claim 1, wherein the guide member is disposed between the first wall and the first film.

10. The ink tank of claim 1 further comprising a latch extending from the third wall.

11. The ink tank of claim 1, the second film comprising an absorbent material.

12. The ink tank of claim 1, the second film comprising an ink fixing material.

13. The ink tank of claim 1, the ink outlet including a raised rim, wherein the first film is adhered to the raised rim.

14. The ink tank of claim 1, wherein the first film is sealingly adhered with an adhesive.

15. The ink tank of claim 1, wherein the first film is heat staked to the sealing area.

16. The ink tank of claim 1, wherein the first film is ultrasonically welded to the sealing area.

17. The ink tank of claim 1, the first film including a first side and a second side opposite the first side, wherein the first side is sealed to the sealing area, and wherein the second side includes a label.

18. The ink tank of claim 1, wherein the second film is disposed between the first film and the wall.

19. The ink tank of claim 1, wherein the first film includes a fold.

20. An ink tank that is mountable to a printhead, the ink tank comprising:

an ink outlet configured to supply ink to the printhead;

a first film including a sealing portion that is adhered to a sealing area surrounding the ink outlet;

a second film adhered to the first film; and a guide member that is configured to guide the second film toward the sealing portion of the first film when the first film is removed from the sealing area.

* * * * *